US005568229A

United States Patent [19]

Szlucha

[11] Patent Number: 5,568,229

[45] Date of Patent: Oct. 22, 1996

[54] FUSER TEMPERATURE CONTROL AS A FUNCTION OF COPY SHEET CHARACTERISTICS

[75] Inventor: Thomas F. Szlucha, Fairport, N.Y.

[73] Assignee: Xerox Corporation, Stamford, Conn.

[21] Appl. No.: 493,064

[22] Filed: Jun. 21, 1995

[51] Int. Cl.[6] ..... G03G 21/00

[52] U.S. Cl. ..... 355/208; 355/285; 219/216

[58] Field of Search ..... 355/208, 204, 355/285, 282, 311; 219/216

[56] References Cited

U.S. PATENT DOCUMENTS 4,372,675 2/1983 Sahay .

4,825,242 4/1989 Elter .

5,436,709 7/1995 Sakaizawa et al. ..... 355/208 X

*Primary Examiner*—R. L. Moses

*Attorney, Agent, or Firm*—Ronald F. Chapuran

[57] ABSTRACT

A technique of adjusting the operation of a fuser in accordance with the size and orientation of copy sheets being fused. A controller includes a table in memory for storing fuser operation data related to given copy sheet size and orientation and tracks the operation of the fuser by determining the size and orientation of copy sheets being delivered to the fuser, scanning the table in memory to locate size and orientation identifiers and fuser operation data, and adjusts the operation of the fuser in accordance with the operation data by counting the number of copies being fused and placing the machine in idle for a given period of time upon reaching a predetermined copy count.

10 Claims, 5 Drawing Sheets

FUSER TEMPERATURE CONTROL AS A FUNCTION OF COPY SHEET CHARACTERISTICS

BACKGROUND OF THE INVENTION

The invention relates to fuser control, in particular, to a system of fuser temperature control as a function of copy sheet characteristics.

Reproduction machines such as copiers and printers continue to have increasing demands on the variety of jobs to be accomplished. One such demand is to be able to manipulate copy sheets of varying characteristics such as size, weight, and material. In addition, there is often the need to alter the orientation of the copy sheets throughout the copy sheet path. One element of a printer or reproduction machine that is often stressed by varying copy sheets is the fuser element. A fuser roll can easily be subjected to significant temperature variations along its axis by copy sheets of different characteristics. For example, a copy sheet of a width significantly shorter than the heating element used for a more standard size copy sheet, will cause a substantial differential of temperature across the fuser roll. This will cause premature stress and deterioration of the fuser roll.

A possible solution is the use of multiple heating elements. A difficulty with multiple heating elements is the cost as well as the problem of selecting heating elements that conform to the variety of copy sheets available at various sizes. In the prior art, U.S. Pat. No. 4,372,675 discloses a method for adjusting fuser operation in response to variable available power. In particular, with less than full power available to the machine, the fuser is operated at less than full power. Upon detecting that the fuser temperature has fallen below a threshold level, the machine is set in standby and full power is applied to the fuser to return the fuser temperature to an acceptable level to continue operation. This system, however, is not concerned with the deterioration of a fuser roll by fusing copy sheets of variable characteristics.

It would be desirable, therefore, to overcome the limitations of the prior art in avoiding wear and tear on fuser rolls caused by fusing non uniform copy sheets. An object of the present invention, therefore, is to provide a technique to evade unnecessary component deterioration on a fuser roll required to receive copy sheets of varying characteristics. Another object of the present invention is to be able to adjust the operation of a fuser heating element in response to copy sheet characteristics such as size, weight, material, and orientation. Further advantages of the present invention will become apparent as the following description proceeds, and the features characterizing the invention will be pointed out with particularity in the claims annexed to and forming a part of this specification.

SUMMARY OF THE INVENTION

Briefly, the present invention is concerned with a technique of adjusting the operation of a fuser in accordance with the characteristics of copy sheets being fused. A controller includes a table in memory for storing fuser operation data related to given copy sheet characteristics and tracks the operation of the fuser by determining the characteristics of copy sheets being delivered to the fuser. The controller scans the table in memory to locate characteristic identifiers and fuser operation data, and adjusts the operation of the fuser in accordance with the operation data by counting the number of copies being fused and placing the machine in idle for a given period of time upon reaching a predetermined copy count.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
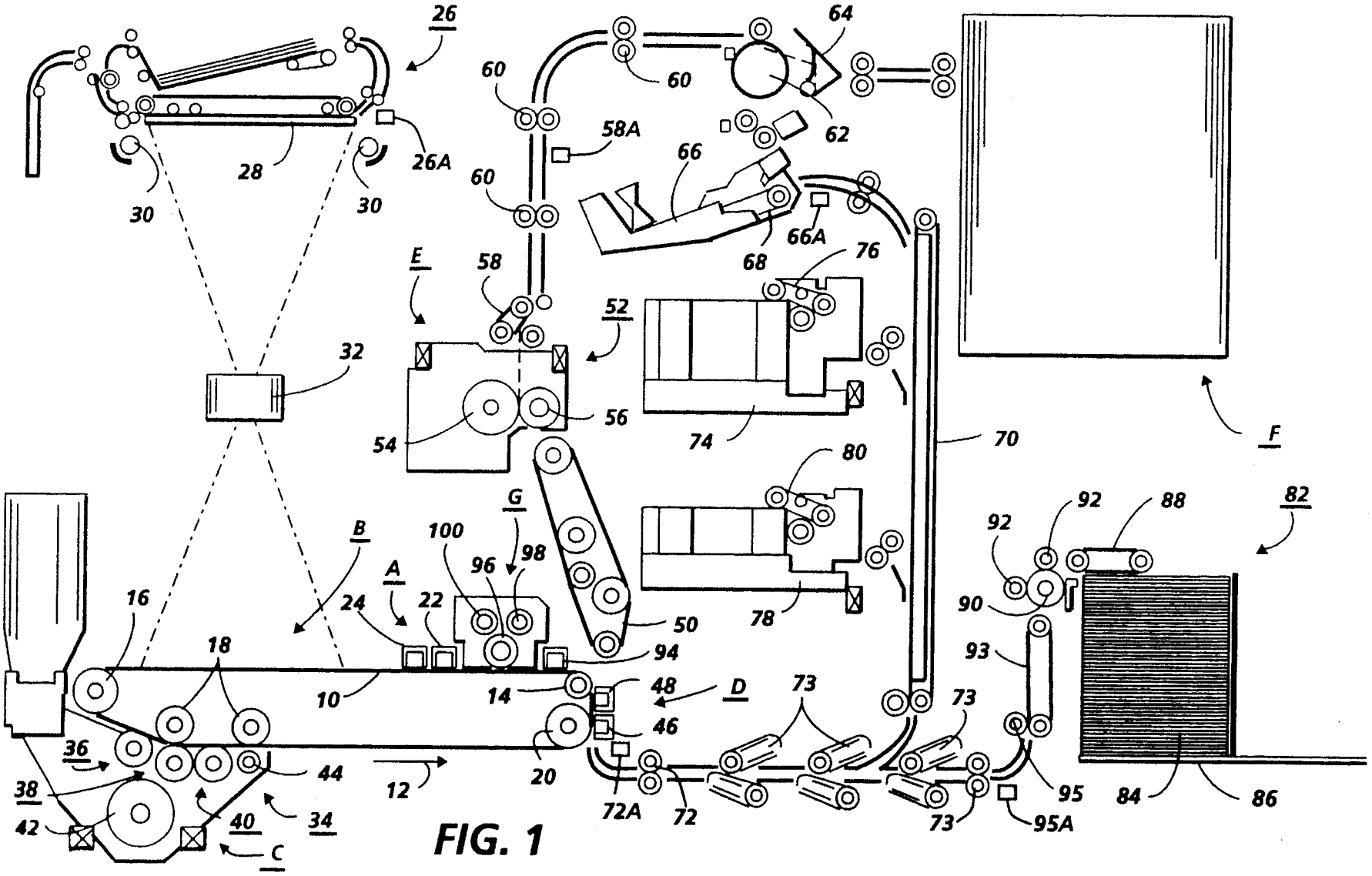
FIG. 1 is a schematic elevational view depicting various operating components and sub-systems of a typical machine incorporating the present invention.
Figure 2:
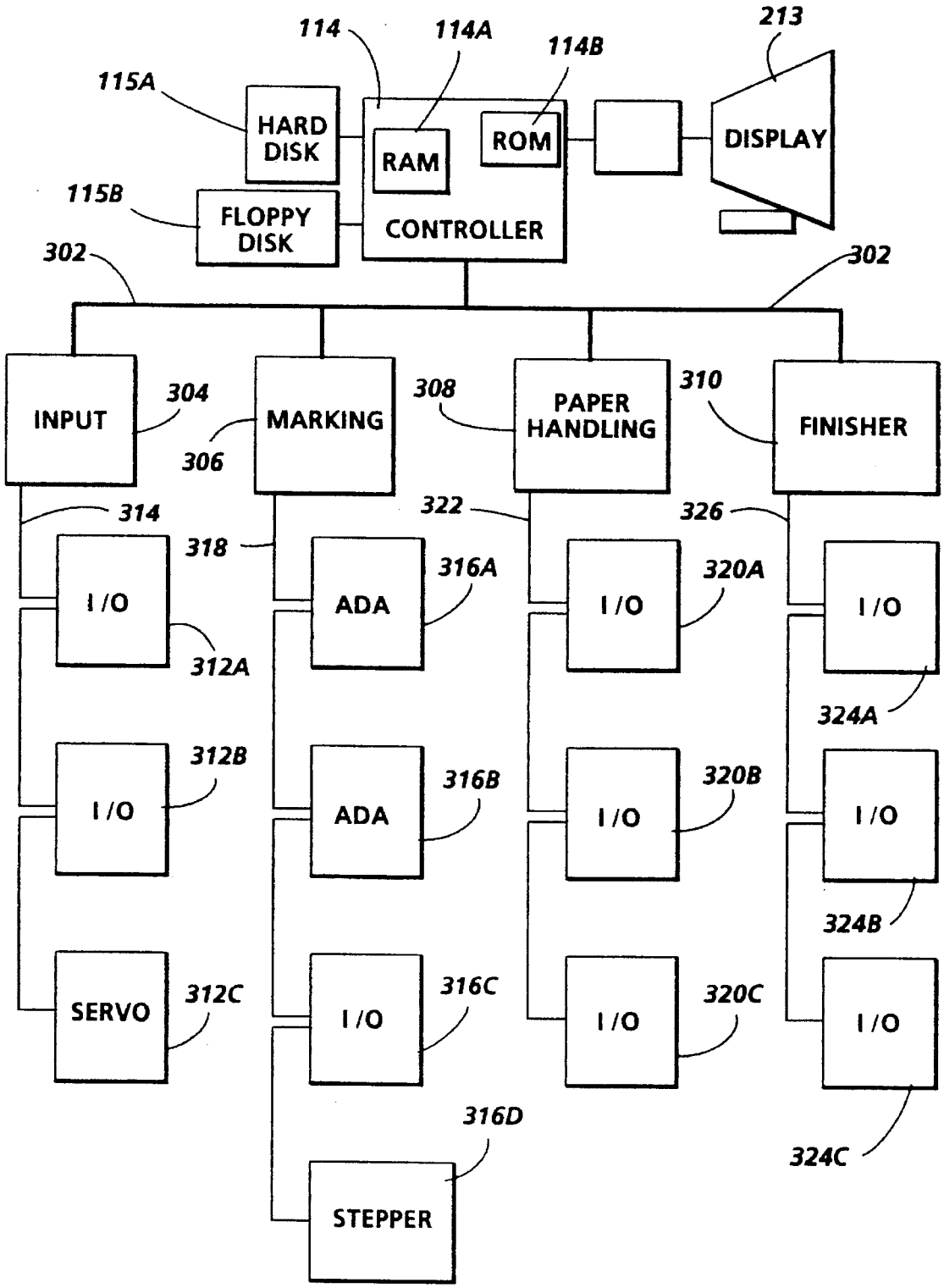
FIG. 2 is a block diagram of the operating control system and memory for the machine shown in FIG. 1.

Referring to FIGS. 1 and 2, there is shown a typical electro-photographic reproduction machine employing a photoconductive belt 10 with a drive roller 20 rotated by a motor coupled thereto by suitable means such as a belt drive. As roller 20 rotates, it advances belt 10 in the direction of arrow 12 through various processing stations.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the Copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95 and rolls 72 move the sheet to transfer station station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

With reference to FIG. 2, the various functions of machine 5 are regulated by a controller 114 which preferably comprises one or more programmable microprocessors. The controller provides a comparison count of the copy sheets, the number of documents being recirculated, the number of copy sheets selected by the operator, time delays, jam corrections, etc.. As will appear, programming and operating control over machine 5 is accomplished through a user interface 213. Operating and control information, job programming instructions, etc. are stored in a suitable memory which includes both RAM 114A and ROM 114B,the former being also used to retain jobs programmed through U.I. 213. It should be understood that the memory may comprise a series of discrete memories.

In one embodiment, the memory includes a hard or rigid disk drive 115A and a floppy disk drive 115B connected to Controller 114. The display of U.I. 213 is also connected to Controller 114 as well as a shared line system bus 302. The shared line system bus 302 interconnects a plurality of core printed wiring boards including an input station board 304, a marking imaging board 306, a paper handling board 308, and a finisher/binder board 310. Each of the core printed wiring boards is connected to local input/output devices through a local bus. For example, the input station board 304 is connected to digital input/output boards 312A and 312B and servo board 312C via local bus 314. The marking imaging board 306 is connected to analog/digital/analog boards 316A, 316B, digital input/output board 316C, and stepper control board 316D through local bus 318. In a similar manner, the paper handling board 308 connects digital input/output boards 320A, B and C to local bus 322, and finisher/binder board 310 connects digital input/output boards 324A, B and C to local bus 326.

Figure 3:
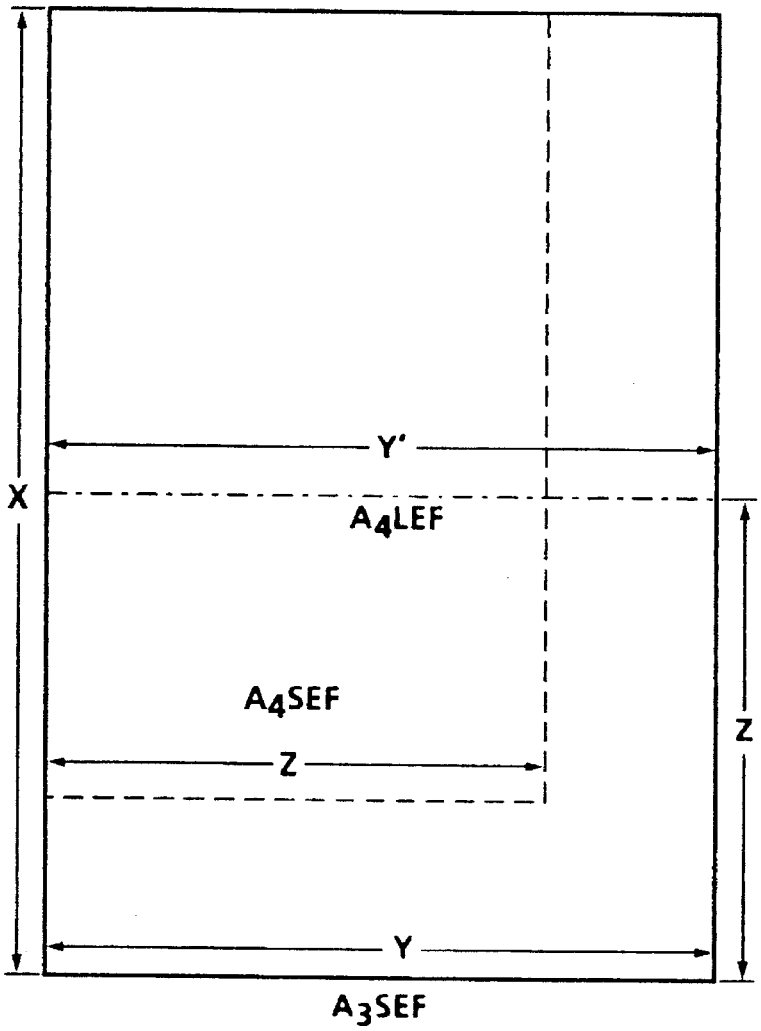
FIG. 3 is an illustration of copy sheet size and orientation influencing fuser performance.

To illustrate the present invention, FIG. 3 shows two paper sizes, in particular an A3 size defined by length X and width Y and an A4 size paper defined by length Y and width Z. It should be noted the A4 size is Y one-half the A3 size. Thus, the short edge of the A3 size paper is the dimension, the long edge of the A4 size paper is the Y dimension, and the short edge of the A4 size paper is the Z dimension.

In discussing the feeding of copy sheets into a fuser, it is convenient to use the terms long edge feed (LEF) and short edge feed (SEF). Thus, the Y dimension is the short edge feed for A3 size paper and the long edge feed for A4 size paper.

Figure 4:
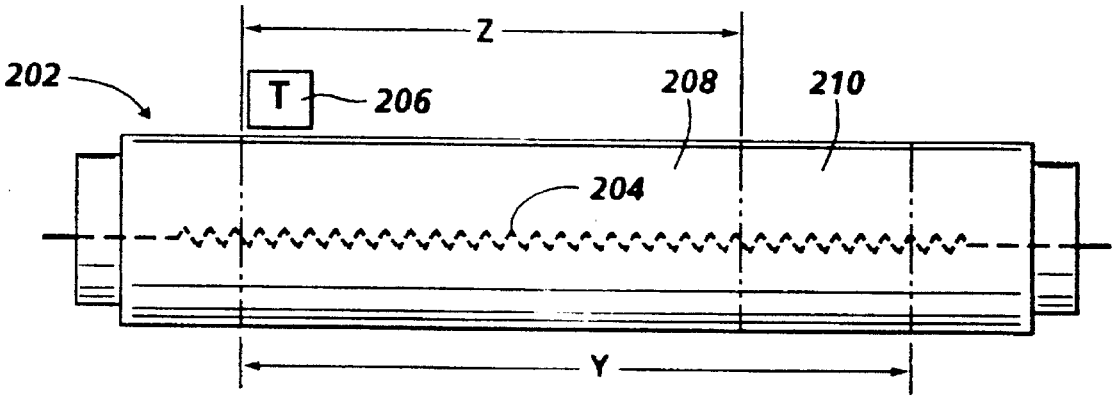
FIG. 4 shows the relative positioning of the copy sheets shown in FIG. 3 on a fuser roll.

A typical fuser roll 202 in a reproduction or printing machine is shown in FIG. 4 and generally includes a heating element 204 as well as a control point or temperature sensor 206 to monitor the fuser temperature. It is generally understood that to operate efficiently, a fuser roll temperature should not drop below a predetermined temperature and that if the fuser roll temperature reaches extreme temperatures, premature component wear could result. In a fuser roll having a single heating element such as 204, as an uneven temperature distribution over the fuser roll results from the fusing of copy sheets presenting feeding edges of different dimensions.

Thus, the short edge Y of A3 size paper presents a different feed dimension to the fuser roll then the short edge dimension Z of A4 size paper. The results are illustrated in FIG. 4 whereas feed edge dimension Y, heat is transferred from the fuser roll to the copy sheet paper along the length of the fuser roll. For a feeding edge of dimension Z, the fuser roll is presented a copy sheet dimension that does not extend the length of the fuser roll. Thus, only that portion of the heating element identified at 208 actually transfers heat to the copy sheet, leaving a section 210 of the heating element where heat is not being removed.

Figure 5A:
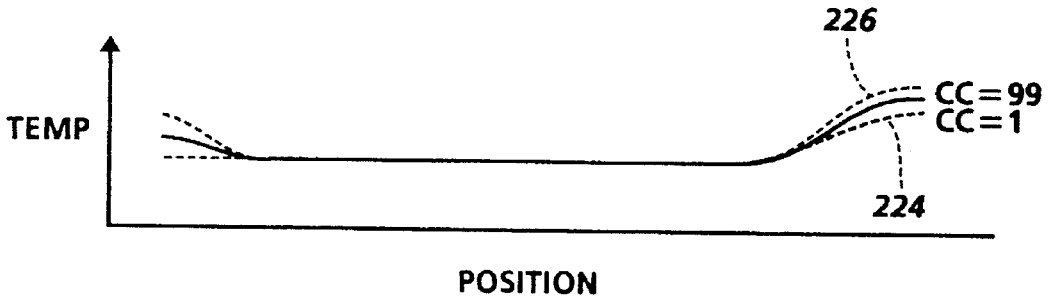
FIGS. 5A and 5B are an illustration of the temperature effects on a fuser roll in accordance with copy sheet size and orientation.
Figure 5B:
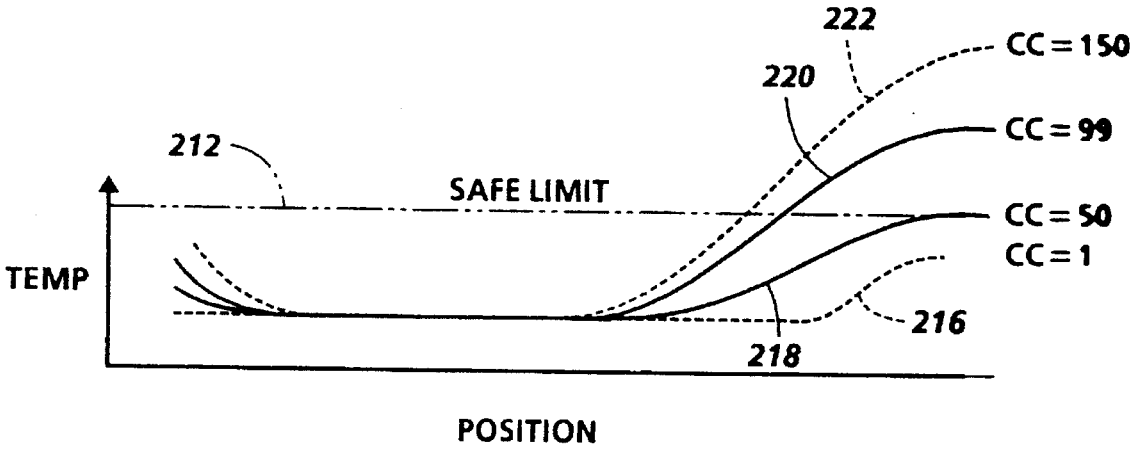

The effects of the different size feed edges on the temperature of the fuser roll is illustrated in FIGS. 5A and 5B. In particular, FIG. 5A illustrates an A4 size long edge feed and a A3 size short edge feed which is the dimension Y in either case. There is a relatively small incremental temperature increase at the edge of the fuser roll as shown by the graph 224 after one copy sheet is fused and the graph 226 after 99 copy sheets are fused.

On the other hand, there is illustrated the temperature characteristics for the fusing of copy sheets of an A4 size short edge feed which is the dimension Z shown in FIG. 3. As shown in FIG. 5B, a safe temperature limit is shown by the horizontal bar 212. Graph 216 shows the temperature rise at the edge of the fuser roll after the fusing of one copy sheet and graph 218 illustrates the temperature rise after the fusing of 50 copy sheets at the edge of the fuser roll which is approaching the safe temperature limit shown at 212. Graphs 220 and 222 illustrate the temperature rise for 99 and 150 fused copy and sheets at the edge of the fuser roll, far in access of the safe temperature limit. In the given example for fusing A4 short edge feed paper, the fuser roll would rapidly increase to an undesirable temperature level to the detriment of the fusing operation as well as the degradation of the fuser itself.

Figure 6:
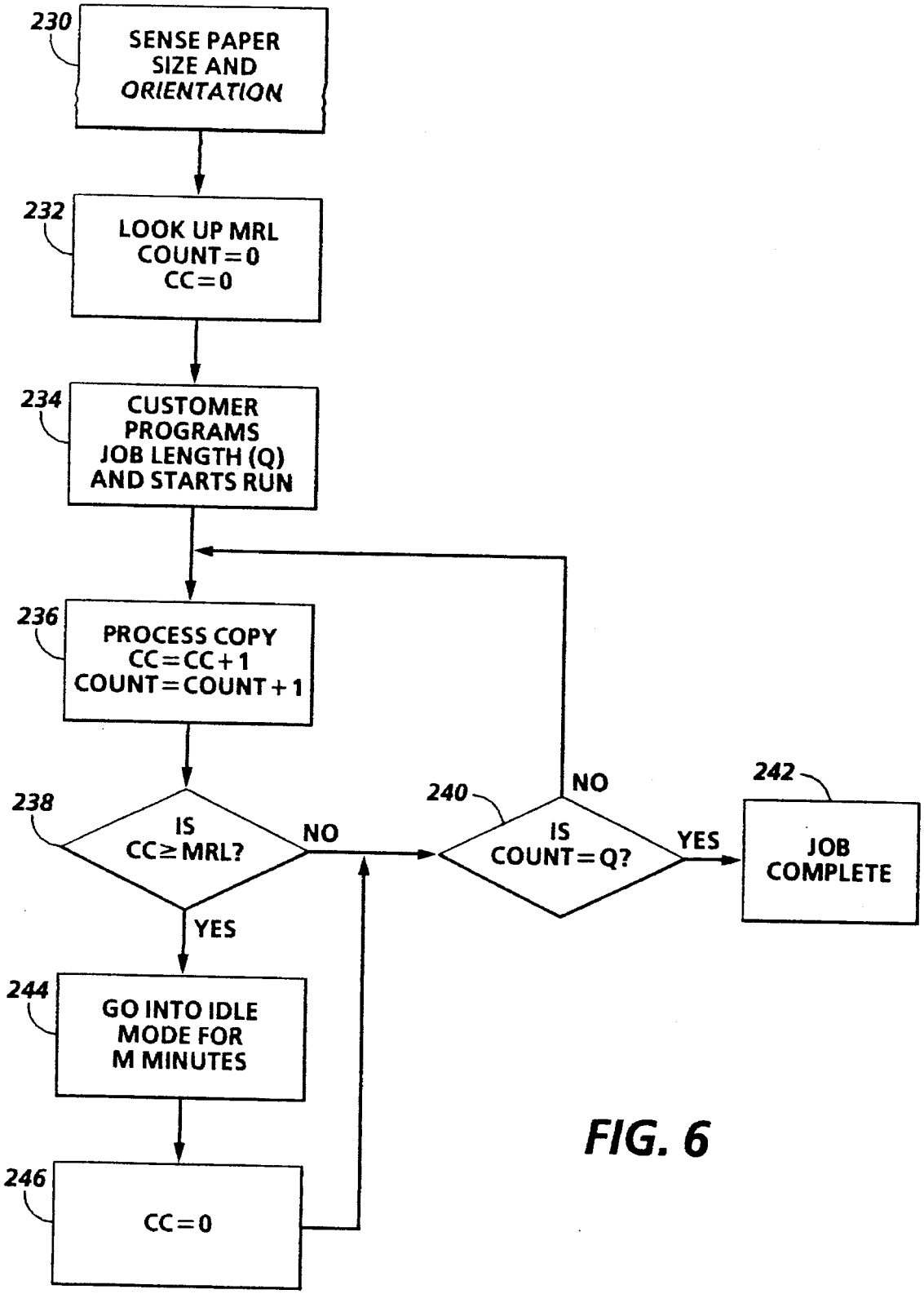
FIG. 6 is a flow chart illustrating the control of fuser operation to compensate for copy sheet size and orientation in accordance with the present invention.

In accordance with the present invention, there is a simple and reliable technique to operate a fuser roll while still being able to feed various size copy sheet edges as illustrated in FIG. 6. In particular, a predetermined temperature safe limit is monitored and upon reaching the safe limit, the fuser is inactivated and the machine idled until the temperature of the edge of the fuser drops to an acceptable level to resume the fusing operation. The fuser temperature can be monitored directly to determine that the safe threshold has been reached such as by an additional sensor located in proper position or by any other technique such as by monitoring a time period of idleness after a given temperature determination. Upon reaching the threshold temperature either by counting the number of copies fused at a given copy sheet feed dimension or by directly measuring temperature, the machine is idled until the temperature has dropped to the acceptable level.

This technique is illustrated in the flow chart in FIG. 6. The sensing of the paper size and orientation is illustrated in block 230. This can be by any suitable automatic measuring and sensing technique or by manually entering size and orientation information into the control. The next step as shown in block 232 is to refer to a look up table to determine the maximum run length (MRL) of the fuser depending upon the size and orientation of the copy sheet at the fuser. For example, in one embodiment, if the orientation at the fuser is the long edge feed for A4 size paper or short edge feed for a A3 size paper, then there would be an unlimited run length. In other words, in one embodiment the fuser system is designed for unlimited fusing of copy sheet paper have the long edge feed length of A4 size paper and the short edge feed length of A3 size paper. However, for differing sized edge length such as short edge feed for A4 size paper or short edge feed for A5 size paper, the table would indicate a maximum run length or the maximum number of copies at that particular edge orientation.

Suitable counters would be set to monitor the number of copies fused. Thus, for other than A4 long edge or A3 short edge, a counter is set to count the number of copies as illustrated in block 232.

In block 234 the job length is programmed and the run initiated and at block 236 a running cumulative total of the copy sheets fused is maintained. At the decision block 238 there is a determination whether or not the maximum run length has been exceeded. If not, there is another decision block as to whether or not the count is equal to a predetermined total job count as shown at block 240. If not, the process continues and the counter is incremented at another count for the next copy sheet fed. If at block 240 the count has reached the predetermined total job count then the job is complete as shown at block 242. On the other hand, if the count has exceeded or is equal to the maximum run length as determined in block 238, the machine will then go into an idle mode for M minutes. M minutes is any predetermined number for a given paper size an orientation that will sufficiently reduce the temperature of the fuser roll edge or edges to begin the fusing operation again.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. In an imagine processing apparatus for producing images on copy sheets, the apparatus including a fuser, a copy sheet path, a sensor for sensoring copy sheet size and a controller for directing the image processing apparatus, the controller tracking the operation of the fuser according to the size of copy sheets, the controller including a table in memory for storing fuser operation data related to given copy sheet size a method of adjusting the operation of the fuser in accordance with the size of copy sheets being fused comprising the steps of:

determining the size of copy sheets being delivered to the fuser:

scanning the table in memory storing the fuser operation data to locate said size, and responsive to the table in memory, identifying the fuser operation data related to said size and counting the number of copy sheets and adjusting the operation of the fuser in accordance with the operation data.

2. The method of claim 1 wherein the step of adjusting the operation of the fuser includes the step of idling the fuser for a given set time period.

3. The method of claim 1 wherein the step of adjusting the operation of the fuser includes the step of operating the fuser up to a given temperature.

4. In an image processing apparatus for producing images on copy sheets, the apparatus including a fuser, and a controller for directing the image processing apparatus, the controller storing fuser operating data and tracking the operation of the fuser according to the size and orientation of copy sheets, a method of adjusting the operation of the fuser in accordance with the size and orientation of copy sheets being fused comprising the steps of:

sensing a first size and orientation of copy sheets at the fuser;

comparing the first size and orientation of copy sheets to a reference in the controller, and responsive to the comparison of the first size to the reference, adjusting the operation of the fuser.

5. The method of claim 4 wherein the reference is a table in memory associating given sizes and orientations of copy sheets to modes of operation of the fuser.

6. The method of claim 4 wherein the step of adjusting the operation of the fuser includes the step of counting the number of fused copy sheets.

7. The method of claim 4 wherein the step of adjusting the operation of the fuser includes the step of shutting off the fuser for a given set time period.

8. The method of claim 4 wherein the step of adjusting the operation of the fuser includes the step of operating the fuser up to a given temperature.

9. In an image processing apparatus for producing images on copy sheets, the apparatus including a fuser, a copy sheet path and a sensor for sensing copy sheet characteristics along the path, and a controller for directing the image processing apparatus, the controller tracking the operation of the fuser according to the characteristics of copy sheets, the controller including a table in memory for storing fuser operation data related to given copy sheet characteristics including size and orientation, a method of adjusting the operation of the fuser in accordance with the characteristics of copy sheets being fused comprising the steps of:

determining the characteristics including size and orientation of copy sheets being delivered to the fuser;

scanning the table in memory storing the fuser operation data to locate said characteristics, responsive to the table in memory, identifying the fuser operation data related to said characteristics, and adjusting the operation of the fuser in accordance with the operation data including the steps of counting the number of copies being fused and placing the machine in idle for a given period of time upon reaching a predetermined copy count.

10. In an image processing apparatus for producing images on copy sheets, the apparatus including a fuser, a copy sheet path and a sensor for sensing copy sheet size and orientation along the path, and a controller for directing the image processing apparatus, the controller tracking the operation of the fuser according to the size and orientation of copy sheets, the controller including a table in memory for storing fuser operation data related to given copy sheet size and orientation, a method of adjusting the operation of the fuser in accordance with the size and orientation of copy sheets being fused comprising the steps of:

determining the size and orientation of copy sheets being delivered to the fuser;

scanning the table in memory storing the fuser operation data to locate size and orientation identifiers, responsive to the table in memory, identifying the fuser operation data related to said size and orientation, and adjusting the operation of the fuser in accordance with the operation data including the steps of counting the number of copies being fused and placing the machine in idle for a given period of time upon reaching a predetermined copy count.

* * * * *